US005699327A

United States Patent [19]

Boissenin et al.

[11] Patent Number: 5,699,327

[45] Date of Patent: Dec. 16, 1997

[54] TIMEPIECE COMPRISING A CONTROL MECHANISM WITH A STEM AND A PULL-OUT PIECE

[75] Inventors: Olivier Boissenin, Cortaillod; Daniel Knuchel, Biel, both of Switzerland

[73] Assignee: SMH Management Services AG, Switzerland

[21] Appl. No.: 697,928

[22] Filed: Sep. 3, 1996

[30] Foreign Application Priority Data

Sep. 4, 1995 [CH] Switzerland ..... 02504/95

[51] Int. Cl.[6] ..... G04B 37/00; G04B 29/00

[52] U.S. Cl. ..... 368/308; 368/319

[58] Field of Search ..... 368/185, 190, 368/288, 306, 307, 308, 319–321

[56] References Cited

U.S. PATENT DOCUMENTS

| | | | |
|---|---|---|---|
| 4,469,448 | 9/1984 | Muller . | |
| 4,979,156 | 12/1990 | Kester | 368/285 |
| 5,043,958 | 8/1991 | Kaelin | 368/379 |
| 5,598,383 | 1/1997 | Li | 368/291 |

FOREIGN PATENT DOCUMENTS

| | | |
|---|---|---|
| 1129351 | 1/1957 | France . |
| 324260 | 10/1957 | Switzerland . |
| 356718 | 10/1961 | Switzerland . |
| 558 039 | 8/1974 | Switzerland . |

*Primary Examiner*—Vit W. Miska

*Attorney, Agent, or Firm*—Pollock, Vande Sande & Priddy

[57] ABSTRACT

A timepiece 1 comprising in particular a case 8 having a back cover 10 and a middle part 12 in a single piece, a control stem 26 co-operating with a pull-out piece 44, and an extractor device 48 enabling a part of the pull-out piece 44 to be raised to free it from the control stem 26. The timepiece is characterized in that the extractor device 48 comprises an extractor element 48 having a first branch 50 which slides in the movement 2 in a direction substantially perpendicular to the plane of the movement 2, the end of said first branch 50 being substantially facing the pull-out piece 44, and a second branch 52 which comprises a portion projecting from the periphery of the movement 2 to form a gripping arm. The extractor element 48 is free to move between a first position called the rest position, in which it does not act on the pull-out piece 44, and a second position called the operating position, in which the end of the first branch 50 pushes the pull-out piece 44 out of the groove of the control stem 26.

10 Claims, 2 Drawing Sheets

TIMEPIECE COMPRISING A CONTROL MECHANISM WITH A STEM AND A PULL-OUT PIECE

FIELD OF THE INVENTION

The invention concerns a timepiece comprising a control mechanism with a stem and pull-out piece. More particularly, the invention concerns a wristwatch comprising a one-piece case, i.e. having a middle part and a back cover made in a single piece, fitted with a device enabling the pull-out piece to be acted upon to release the control stem which acts on the movement, such as the winding or hand-setting stem of the timepiece, to pull such control stem longitudinally outwards from the case so that the movement may be taken out of the case from above when the watch glass is removed.

BACKGROUND OF THE INVENTION

In conventional designs of such timepieces, the pull-out piece, which is mounted so as to swivel on the bottom plate of the movement, is subject to the action of a strip-spring which engages a projecting part arranged at one end of the pull-out piece in a groove of the control stem, the other end of the pull-out piece being intended to control a lever engaged in the groove of a sliding pinion which is mounted so as to slide freely on the winding stem.

It happens that, after the casing up of movements in one-piece cases and the placing of the hand setting stems, it is noticed, during a subsequent inspection stage, that the movement or the case has certain defects. It is then often necessary to remove the movement from the case in order to act on one or other of such elements.

For example, in order to recover a defective movement which is housed in a one-piece case made of a plastic material, the back cover of the case is generally pierced facing an appropriate opening arranged in the movement in the pull-out piece area and a tool capable of freeing the pull-out piece from the winding stem is inserted into this opening, which thus enables such stem to be pulled out. The movement may then be easily removed from the case from above, in a conventional manner, once the watch glass is taken out. The case is thus unable to be used after this operation. If such a practice is of only little economic consequence in the case of plastic cases, the material being able to be recycled easily and its cost being relatively low, it is easily understood that this is not the case, for obvious reasons of cost, when it comes to acting on a movement mounted in a one-piece case made of metal.

The current solutions of the prior art for overcoming this problem consist, either of providing a stem which can be pulled out, i.e. comprising a slanted edged groove in which the end of the pull-out piece is engaged, which is unreliable because of a significant risk that the stem is pulled out by the user, or of providing a jointed type stem, which is more expensive because of the significant number of additional pieces which it requires to be used.

Patent document CH 558,039 proposes to overcome this problem by providing a watch of the aforementioned type comprising an extractor lever, whose free end projects from the movement and whose opposite end acts on an end of the swivelling shaft of the pull-out piece so that, when pressure is exerted on the projecting part of the lever, the shaft of the pull-out piece moves longitudinally against the effect of the action of a strip-spring and raises the pull-out piece so that the projecting part frees itself from the groove of the stem. The stem can then be pulled out of the movement.

This design has the disadvantage however of requiring a particular pull-out piece shaft—longer than a conventional shaft—and a special assembly of such shaft in the frame of the movement, so that, on the one hand, it is free to move longitudinally in the frame, and, on the other hand, one of its ends can co-operate with the end of the extractor lever. This design also necessitates a free space above the entire pull-out piece so that it can move upwards.

SUMMARY OF THE INVENTION

A principal aim of the invention is thus to overcome the aforementioned disadvantages of the prior art by providing a timepiece having a case of the one-piece type and comprising a control mechanism with a stem and a pull-out piece, such timepiece being fitted with a simple economical device which does not require any particular adaptation of the assembly of the pull-out piece on the frame of the movement and which enables the pull-out piece to be raised in order to free it from the winding stem without having to pierce the back cover of the case, The invention thus concerns a timepiece comprising:

- a case having a back cover and a middle part in a single piece, closed by a watch glass;
- a clockwork movement housed in said case;
- a control mechanism acting on said movement;
- said control mechanism comprising a control stem which passes through said middle part, said stem having a first end which extends outside said case and a second end which extends into said movement, and a pull-out piece, one part of which is engaged in a groove of the control stem, and
- an extractor device enabling said part of the pull-out piece to be pushed to free it from the control stem, said timepiece being characterised in that the extractor device comprises an extractor element having a first branch which slides inside the movement in a direction substantially perpendicular to the plane of the movement, one end of said first branch being substantially facing the pull-out piece, and a second branch which comprises a projecting portion from the periphery of the movement to form a gripping arm, said extractor element being free to move between a first position called the rest position in which it does not act on the pull-out piece and a second position called the operating position in which the end of the first branch pushes the pull-out piece out of the control stem groove.

As a result of these features, there is provided a device which, once the watch glass has been removed, enables the extractor element to be slid by means of a simple gripping tool, such as pliers, to raise the pull-out part and release the control stem. Furthermore, such device enables the design of the assembly of the pull-out piece in the movement to remain unmodified, thus enabling movements of conventional design to be fitted therewith.

According to a preferred embodiment of the invention, the extractor element is U-shaped, the first branch being connected via a central branch to the second branch which extends substantially parallel to the first branch and which comprises a folded back portion which projects from the periphery of the movement to form the gripping arm.

The extractor element may thus be made with the aid of a simple, folded inexpensive element, such as a wire. Furthermore, given the simplicity of the shape of this element, it is easy to assemble on the movement.

According to the advantageous features of the invention, the back cover of the case comprises a recess into which the central branch extends, the latter resting on the bottom of the recess in the rest position of the extractor element.

Thus the extractor element does not require the provision of any particular means for fixing the latter on the movement.

BRIEF DESCRIPTION OF THE DRAWINGS

Other advantages and features of the invention will appear upon reading the detailed description which follows of an embodiment example, given by way of illustrative and non-limiting example in conjunction with the attached drawings in which.

DETAILED DESCRIPTION OF THE INVENTION

Figure 1:
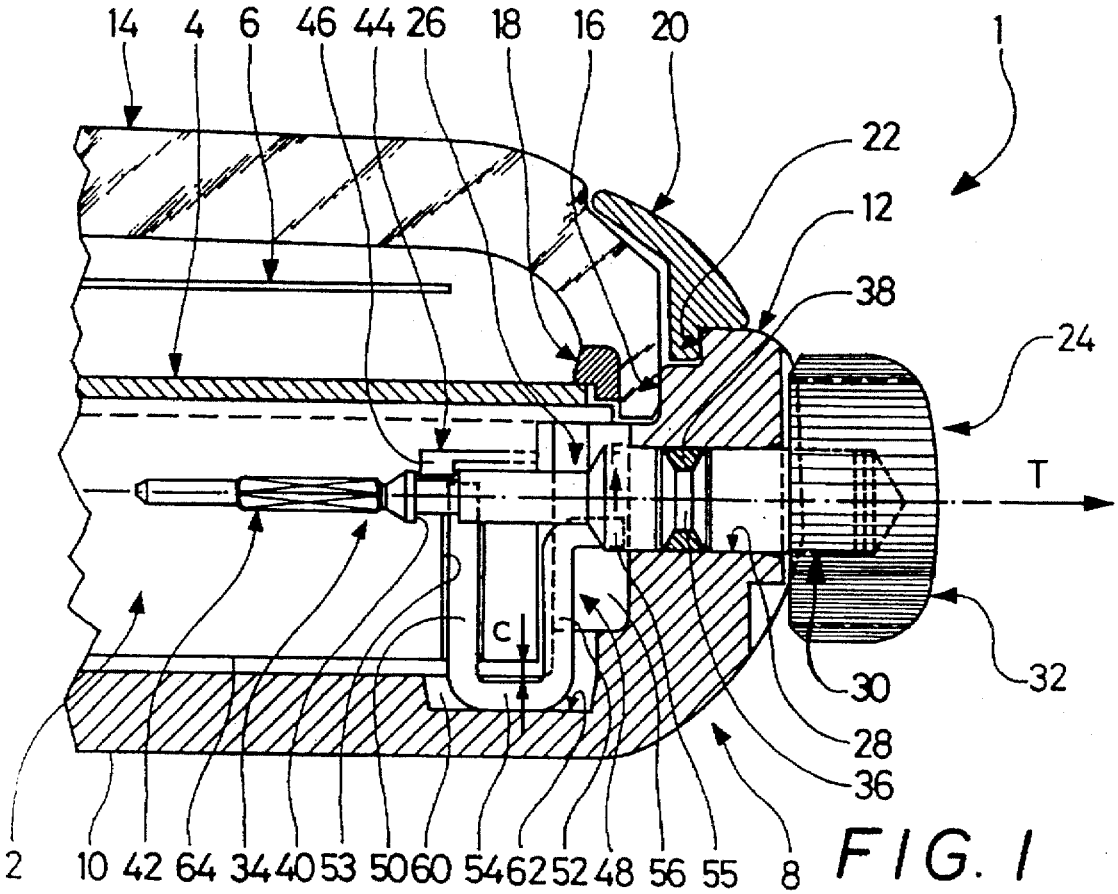
FIG. 1 is a partial axial cross-section of a timepiece comprising an extractor device according to the invention, in which only the elements necessary for the understanding of the invention have been shown, the extractor device being shown in a rest position.

Referring to the figures, there is seen a timepiece according to the invention, designated by the general numerical reference 1. In the example illustrated, such timepiece has the form of a wristwatch.

Watch 1 includes a movement 2, comprising in the conventional manner a bottom plate and bridges (not shown), on which is mounted a dial 4 above which display means 6 move. Movement 2 is housed in a case 8 comprising a back cover 10 and a middle part 12 in a single piece. The case is closed by a watch glass 14 driven in a conventional manner into a first recess 16 of middle part 12. In the example illustrated, watch glass 14 applies a flange 18 against the edge of dial 4. Further, on the peripheral part of watch glass 14 is mounted a decorative bezel 20 driven into a second recess 22 of middle part 12.

Watch 1 additionally comprises a control mechanism 24 which acts on movement 2. Mechanism 24 enables, for example, the hand setting of the watch, and in the case of a mechanical watch, the winding, or even, if necessary, other functions such as the date setting of a calendar indicator, to be effected.

Mechanism 24 comprises a control stem 26 which passes radially through a bore 28 of middle part 12 and which is guided in the latter. Stem 26 comprises a first part 30 which extends outside case 8 and on which is fixed a crown 32, and a second part 34 which extends into a recess (not shown) provided for this purpose in movement 2. The part of stem 26 co-operating with bore 28 is fitted with an annular groove 36 in which a sealing gasket 38 is arranged. Part 24 comprises a groove 40 and a portion of square transversal section 42 intended to co-operate with a square bore of a sliding pinion (not shown).

Mechanism 24 further comprises a pull-out piece 44 (partially shown) mounted so as to swivel on a frame or a bottom plate of movement 2. Pull-out piece 44 comprises a part fitted with a projection 46 which is engaged in groove 40. Such mechanism 24 also comprises means such as resilient means which tend to engage projection 46 in groove 40. In the example illustrated, these resilient means may be formed by the pull-out piece itself as in the present case, or by a strip-spring or suchlike.

For more details as to a possible assembly of pull-out piece 44 in movement 2, reference can be made to U.S. Pat. No. 4,469,448 which discloses an example of a control mechanism with a stem acting on a pull-out piece.

The watch according to the invention further comprises an extractor device 48 intended to raise pull-out piece 44 in order to free projecting part 46 from groove 40 of control stem 26 and to release the latter, by actuating such device from above the watch when watch glass 14 is removed and movement 2 is still encased in one-piece case 8.

In this example, the extractor device comprises a single extractor element 48 which partially extends into a passage (not shown) of movement 2 and partially outside the latter so that it can be accessed for example with a tool such as pliers or suchlike, from above the watch. Extractor element 48 is free to move between a first position called the rest position, shown in FIG. 1, in which it does not act on pull-out piece 44 or in other words it enables pull-out piece 44 to be engaged in groove 40, and a second position called the operating position, shown in FIG. 2, in which extractor element 48 acts directly or indirectly on pull-out piece 44 to push it out of groove 40 of control stem 26.

In the example shown, extractor element 48 has the shape of a "U". Such element 48 comprises a first branch 50 and a second branch 52 which extends substantially parallel to the first branch. First branch 50 and second branch 52 are connected by a central branch 54 which extends substantially perpendicular to branches 50 and 52. First branch 50 slides into movement 2 in a direction substantially perpendicular to the plane of movement 2. Branch 50 in fact slides into a passage 53 (shown schematically in the drawing) of movement 2 which opens out on the one hand into the lower part of movement 2, and on the other hand, substantially facing pull-out piece 44, so that the end of branch 50 is also facing pull-out piece 44, and preferably, facing a part of pull-out piece 44 which is close to projecting part 46. Such a passage may, for example, be formed by the passage normally provided in conventional movements for inserting a tool such as the tip of a screwdriver, in order to release the stem from pull-out piece 44.

Second branch 52 comprises a portion which projects from the periphery of movement 2 to form a gripping arm 55. More precisely, portion 55 is formed by the end part or free end of branch 52 which is folded at 90° towards the outside of the "U". In the example illustrated, branch 52 extends outside movement 2, and gripping arm 55 is housed in a lateral recess 56 arranged in the internal wall 58 of middle part 12 which surrounds movement 2. Extractor element 48 is preferably formed by a folded element of constant transversal section and in particular, by a folded metal wire. Of course, such element 48 could, according to an alternative embodiment, also be made of plastic material, for example, by moulding.

Figure 2:
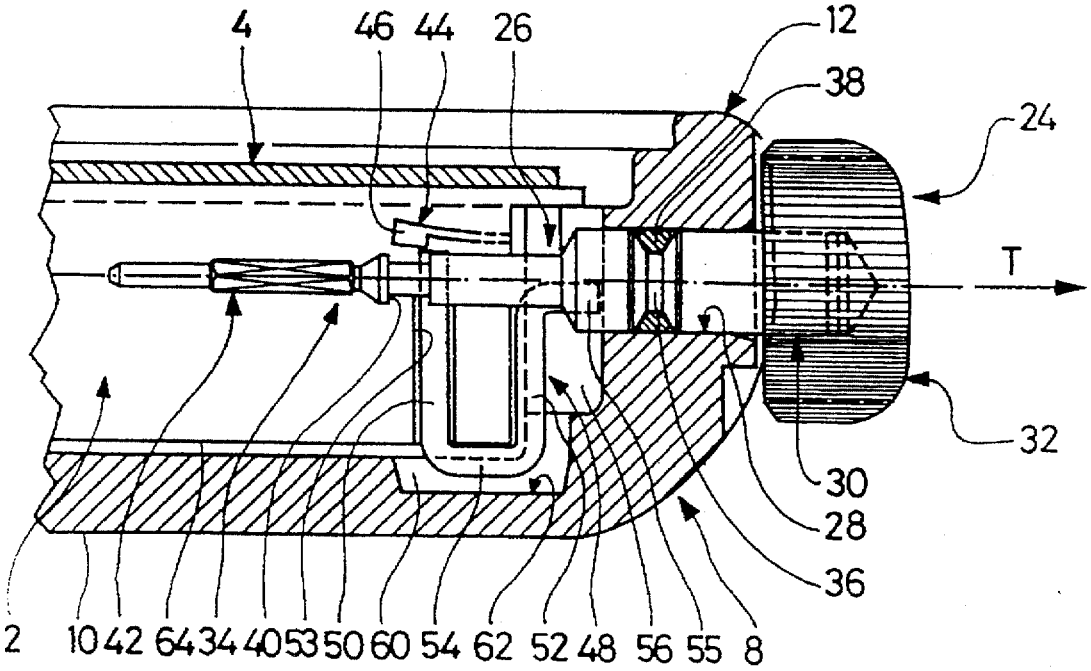
FIG. 2 is a similar cross-section to that of FIG. 1, the extractor device being shown in an operating position and the watch glass and bezel having been omitted.
Figure 3:
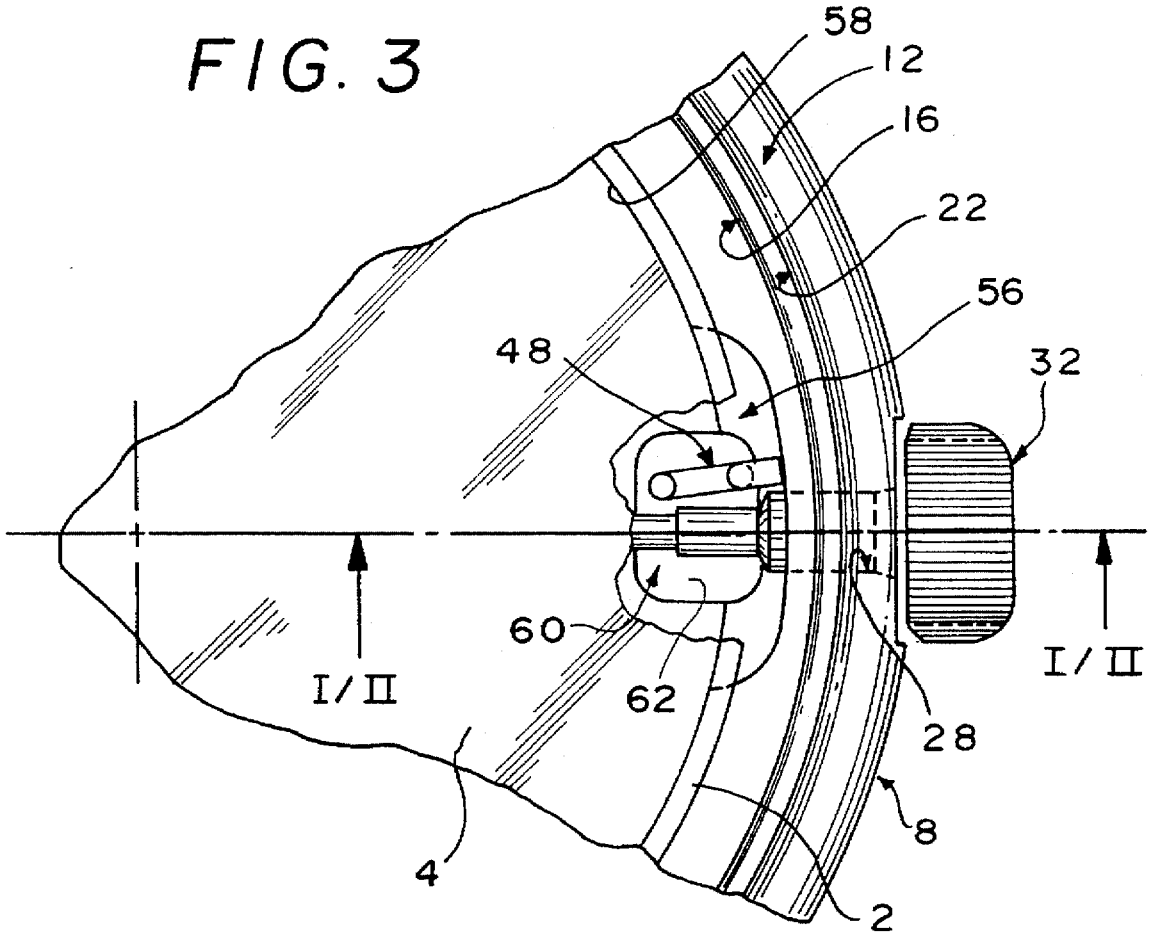
FIG. 3 is a partially torn away partial top view showing a part of the device according to FIG. 2.

Central branch 54 connecting branches 50 and 52 extends outside movement 2 into a recess 60 arranged in back cover 10 of case 8. More precisely, branch 54 rests on the bottom 62 of recess 60 when extractor element 48 is its rest position (FIG. 1). In the example illustrated, the travel C of extractor element 48 is determined by the distance separating bottom 62 of recess 60 of lower surface 64 of the movement to the extent that central branch 54 abuts lower surface 64 in the operating position (FIG. 2) of extractor element 48.

Of course, such travel C will be determined differently according to an alternative embodiment (not shown) in which movement 2 comprises, in its lower part, a recess or notch into which central branch 54 extends at least partially in its operating position, and if necessary, in the rest position of extractor element 48. According to this alternative embodiment, the depth of recess 60 may be reduced or recess 60 may even be completely omitted, travel C then being determined by the height of the notch arranged in the lower part of movement 2 in which branch 54 may be housed in its operating position.

In order to pull out stem 26 and remove movement 2 from timepiece case 8, one proceeds as follows. Bezel 20 and watch glass 14 and, if necessary, dial 4 are taken out in a conventional manner to free access to lateral recess 56. A tool, such as pliers, is then introduced into the latter to grasp arm 55 and to exert a traction on such arm in the direction of arrow F. In doing so, branch 50 slides into the passage 53 of the movement and the end of branch 50 raises pull-out piece 44 and frees it from groove 40. At this moment, it is possible to grasp crown 32 and pull stem 26 in the direction of arrow T, longitudinally out of case 8 since the stem is released from pull-out piece 44. Movement 2 may then be removed without difficulty from case 8 by conventional means.

It will be noted that, in an advantageous manner, extractor element 48 may be mounted just before movement 2 is encased and this simply by introducing branch 50 into the appropriate passage of movement 2 and thus without the necessity of using any tool.

What is claimed is:

1. A timepiece comprising:

a case having a back cover and a middle part in a single piece, being closed by a watch glass, a clockwork movement housed in said case, a control mechanism acting on said movement, said control mechanism comprising a control stem which passes through said middle part, said stem having a first end which extends outside said case and a second end which extends inside said movement, and a pull-out piece, one part of which is engaged in a groove of the control stem, and an extractor device enabling said pull-out piece part to be pushed to free it from the control stem, wherein the extractor device comprises an extractor element having a first branch which slides inside the movement in a direction substantially perpendicular to the plane of the movement, one end of said first branch being substantially facing the pull-out piece, and a second branch which comprises a portion projecting from the periphery of the movement to form a gripping arm, said extractor element being free to move between a first position called the rest position in which it does not act on the pull-out piece and a second position called the operating position in which the end of the first branch pushes the pull-out piece out of the groove of the control stem.

2. A timepiece according to claim 1, wherein the extractor element is U-shaped, said first branch being connected via a central branch to said second branch which extends substantially parallel to the first branch and which comprises a folded back portion projecting from the periphery of the movement to form said gripping arm.

3. A timepiece according to claim 1, wherein said second branch extends outside the movement.

4. A timepiece according to claim 2, wherein said middle part comprises, in an internal wall surrounding the movement, a lateral recess in which is housed said folded back portion of said second branch.

5. A timepiece according to claim 2, wherein said central branch is outside the movement at least in said rest position and wherein said back cover comprises a recess into which said central branch extends in this position.

6. A timepiece according to claim 5, wherein said central branch rests on the bottom of said recess in said rest position of the extractor element.

7. A timepiece according to claim 6, wherein the travel of said extractor element is determined by the distance separating the bottom of the recess from a lower surface of the movement, the central branch then abutting the lower surface of the movement in said operating position of said extractor element.

8. A timepiece according to claim 2, wherein said folded back portion of the second branch is formed by the free end of the latter, folded at 90 degrees.

9. A timepiece according to claim 2, wherein the movement comprises in its lower part a recess into which said central branch extends at least partially in said rest position.

10. A timepiece according to claim 1, wherein said extractor element is formed of a folded element of constant transversal section, in particular a folded metal wire.

* * * * *